United States Patent [19]

Wells et al.

[11] Patent Number: 4,475,659

[45] Date of Patent: Oct. 9, 1984

[54] DISPLAY DEVICE

[76] Inventors: William S. Wells, 7 Melville Ave.; Enrique Fernandez-Lanz, 37 Indian Rock Rd., both of San Anselmo, Calif. 94960

[21] Appl. No.: 333,027

[22] Filed: Dec. 21, 1981

[51] Int. Cl.[3] ..... A47F 5/08

[52] U.S. Cl. ..... 211/55; 40/124; 211/87; 211/45

[58] Field of Search ..... 40/124, 124.4; 211/87, 211/55, 94, 45, 46

[56] References Cited

U.S. PATENT DOCUMENTS

| | | | |
|---|---|---|---|
| 924,667 | 12/1909 | Smith | 40/124 X |
| 1,479,423 | 1/1924 | Barton | 40/124 X |
| 1,790,287 | 1/1931 | Stevens et al. | 40/124 X |
| 2,051,677 | 8/1936 | Brodsky | 40/124 |
| 3,283,430 | 11/1966 | Hintig | 40/124 |
| 4,055,010 | 10/1977 | Fridlund et al. | 40/124 |

FOREIGN PATENT DOCUMENTS

| | | | |
|---|---|---|---|
| 64703 | 12/1955 | France | 40/124 |

*Primary Examiner*—Ramon S. Britts
*Assistant Examiner*—Robert W. Gibson, Jr.
*Attorney, Agent, or Firm*—Melvin R. Stidham

[57] ABSTRACT

A display device for displaying generally planar items such as photographs, cards, letters and the like is formed from a plurality of horizontally extending parallel strips arranged to provide a plurality of leaves in lapping relationship. The outer lower portion of each leaf is formed to provide a pocket for receiving therein the lower margin of the planar element. The upper margin of the element to be displayed may be received under the outer portion of a higher leaf or under the leaf below such higher leaf depending on the height of the element to be displayed.

3 Claims, 7 Drawing Figures

Fig. 1
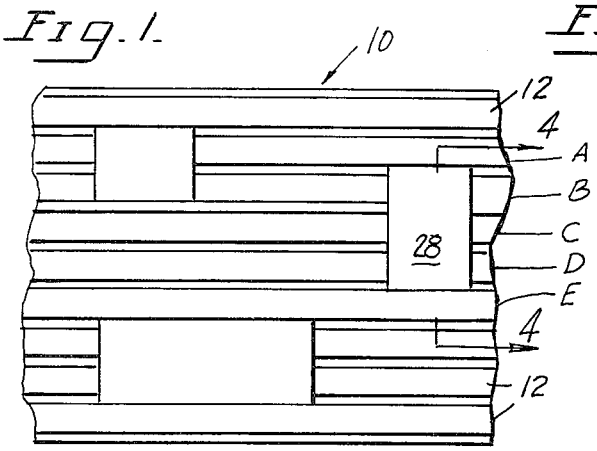
Fig 2
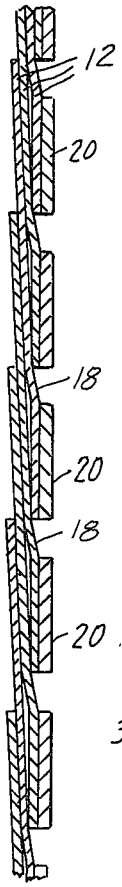
Fig 3
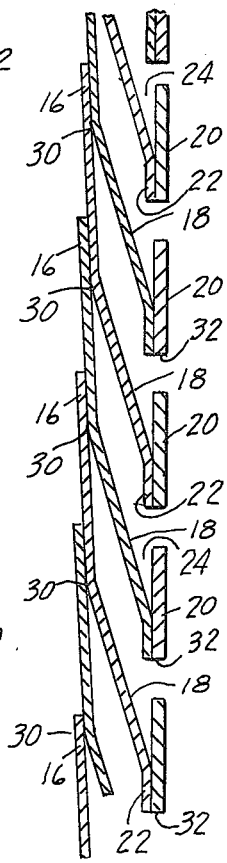
Fig 4
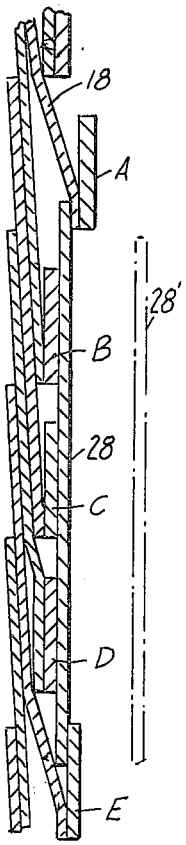
Fig 6
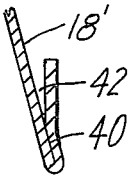
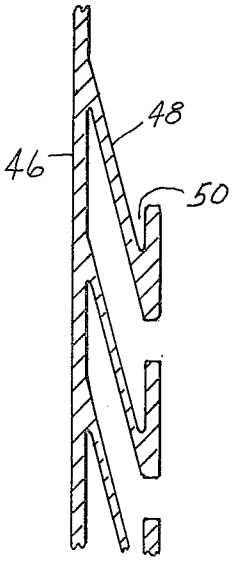
Fig 7
Fig 5
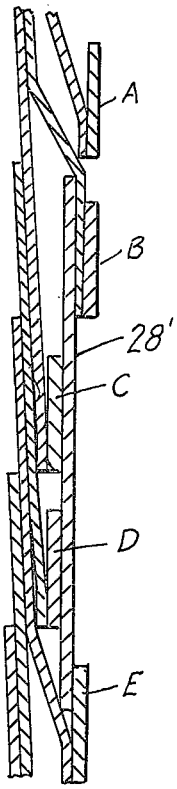

DISPLAY DEVICE

This invention relates to a display device adapted to be supported on a wall or otherwise and formed so as to support items of different sizes such as business cards, photographs, post cards, memos and the like.

Heretofore various types of racks and display devices have been proposed having a somewhat similar object. However in many cases only a card, photo or similar planar element of a particular size can be used on the display device. One example is shown in U.S. Pat. No. 1,400,438.

The main object of the present invention is the provision of a display device for displaying photographs, cards, letters and the like which is adapted to mount the element to be displayed regardless of the dimensions of such element.

Another object of the invention is the provision of a display device which is inexpensive to make and which presents a good appearance to the viewer of the materials to be displayed.

Other objects and advantages will be apparent from the following specification and drawings.

FIG. 1 is a reduced scale elevation of a portion of a display device made in accordance with the invention.

FIGS. 2,3 are greatly enlarged cross sectional views of a typical portion of the device of FIG. 1. The thickness of the elements is greatly exaggerated for clarity of the drawing.

FIG. 4 is a similar view taken in a plane indicated by lines 4—4 of FIG. 1 and showing a typical element mounted for display.

FIG. 5 is a view similar to FIG. 4 but showing the mounting of an element to be displayed which is slightly less in height than the element of FIG. 4.

FIG. 6 is fragmentary cross section of one of the leaves showing a modified form of the same.

FIG. 7 is a typical cross section showing another modified form of the invention.

In detail, and first with reference to FIG. 1, the invention comprises a relatively large panel, generally designated 10, which comprises a plurality of horizontally extending strips 12 of yieldable material such as fabric, paper, paper board or light plastic.

In the preferred form of the invention shown in FIGS. 2–5 each strip is of paper and is adherently secured to an adjacent strip as best seen in FIG. 3. FIG. 2 shows the normal appearance of a typical portion of the device in cross section. Each strip 12 includes an inner portion 16 which is adherently secured to the adjacent strip. In FIG. 3 the outer portion of each strip illustrated has been swung outwardly to illustrate an important feature of the invention. As seen in FIG. 3 each strip includes a leaf portion 18 which is integral with the inner portion 16. As seen in FIGS. 2,3 these leaves are in lapping relation relative to adjacent leaves.

Along the outer margin of each leaf is a relatively narrow strip of paper or paper board indicated at 20. This narrow strip 20 is adherently secured to the outer margin 22 of each leaf 18 along only a portion of the depth of strip 20. This provides an upwardly opening pocket 24 into which may be received the lower margin of the card, photo, letter or other planar element to be displayed. In FIG. 4 such an article to be displayed is a card indicated at 28 and the upper margin of the card is retained under the leaf 18 that is marked A. Thus the card is held in place by leaves A and E with the intermediate leaves B,C,D behind said card.

In the above case the card 28 is of sufficient height to be retained at its upper margin under the leaf A. However, if the card is slightly smaller in height as is the card 28' indicated schematically in dot-dash lines in FIG. 4 it may then be placed under the adjacent leaf B as seen in FIG. 5. This result is possible because the lower edge 32 of each leaf 18 of each strip 12 is below the upper edge or hinge juncture 30 of the adjacent lower leaf.

It will be apparent that more of the upper margin of the displayed element is obscured in FIG. 5 than in FIG. 4 but in most instances only the central portion of the displayed element is to be viewed.

In lieu of the structure of the leaves 18 in FIGS. 2–5 FIG. 6 illustrates a modified form in which the leaf 18' is folded over at its outer margin and adherently secured to itself along a portion of its width as indicated at 40 thus providing a pocket 42 similar to pocket 24 hereinbefore described.

In another form the entire assembly may be extruded as shown in FIG. 7 to provide a main vertically disposed panel 46 leaves 48 and pocket 50. In this case the leaves 48 may be made sufficiently thin so that they normally lie against each other in lapping relationship.

Reference is made to Disclosure Document No. 098623 filed Mar. 17, 1981.

We claim:

1. A display device for displaying generally planar elements and the like comprising:

a plurality of horizontally extending, vertically spaced strips of yieldable material, means securing each of said strips along a hinge line thereon parallel to and spaced above the lower edge thereof, to an adjacent lower strip, to provide a plurality of leaves in lapping relationship, means forming an upwardly opening pocket along said lower edge of each of said leaves adapted to receive therein the lower margin of a generally planar element, said lower edge of each leaf being below the hinge line of the adjacent lower leaf, whereby the lower margin of said element may be received within said upwardly opening pocket, and the upper margin of such element may be received under the lower edge of a higher leaf.

2. A display device according to claim 1 wherein said strips are of paper adherently secured together.

3. A device according to claim 1 wherein said strips are formed by extrusion.

* * * * *